US005138589A

United States Patent [19]

Kimbel

[11] Patent Number: 5,138,589

[45] Date of Patent: Aug. 11, 1992

[54] DISTANCE SELF TIMER

[76] Inventor: Curtis L. Kimbel, 7961 Calle Madrid, Carlsbad, Calif. 92009

[21] Appl. No.: 599,887

[22] Filed: Oct. 19, 1990

[51] Int. Cl.[5] ..... G04F 8/00; G08B 23/00

[52] U.S. Cl. ..... 368/6; 368/113; 340/323 R

[58] Field of Search ..... 368/1.2, 3, 6, 9, 10, 368/107-113; 340/323 R, 901, 903; 377/20

[56] References Cited

U.S. PATENT DOCUMENTS

| | | | |
|---|---|---|---|
| 3,492,582 | 1/1970 | Heywood | 368/12 |
| 3,610,895 | 10/1971 | Wollesen | 235/92 AE |
| 3,795,907 | 3/1974 | Edwards | 340/323 |
| 3,846,704 | 11/1974 | Bessette | 368/9 |
| 3,946,312 | 3/1976 | Oswald | 324/181 |
| 4,530,105 | 7/1985 | Rabinowitz | 377/12 |
| 4,694,295 | 9/1987 | Miller | 340/903 |
| 4,823,367 | 4/1989 | Kreutzfeld | 377/24.2 |
| 4,825,211 | 4/1989 | Park | 340/901 |
| 4,887,281 | 12/1989 | Swanson | 377/24.1 |
| 5,091,895 | 2/1992 | Chatwin et al. | 368/6 |

*Primary Examiner*—Vit W. Miska
*Attorney, Agent, or Firm*—Calif Tervo

[57] ABSTRACT

A device and a method for displaying to a person moving on a course the elapsed time between two points on the course. Generally, the person would be on or in a mode of transportation, such as a race car. A retroreflective switch is attached to the car and includes a transmitter and a receiver. The transmitter emits an infrared light beam such that the light beam strikes a reflector adjacent the course when the car is on the course adjacent the reflector. The receiver includes a light detector that outputs a detection signal in response to detecting the reflected light beam from the reflector. A processor connected to the receiver receives a first detection signal as the car is adjacent a first reflector and receives a second detection signal when the car is adjacent a second reflector and determines the elapsed time between said first and said second detected signals. A display connected to the processor receives the elapsed time and displays it to the person driving the vehicle. A first reflector is disposed adjacent the course adjacent the first point on the course for receiving the light beam emitted from the transmitter and for reflecting the light beam back to the receiver. A second reflector is disposed adjacent the course adjacent the second point on the course and similarly aligned. To display lap time only a single reflector is disposed. The processor will compute, display, and record continuously, regardless of how many reflectors are used.

26 Claims, 1 Drawing Sheet

DISTANCE SELF TIMER

FIELD OF THE INVENTION

This invention relates generally to methods and apparatus for determining the time taken for a person or vehicle to travel a specified distance and more particularly to a device and method for displaying to a person, such as the driver of a race car, the elapsed time between two points.

DESCRIPTION OF THE RELATED ART

It is necessary for race car drivers to know their elapsed time between two points or over a given course. Many factors can affect speed. Some of these factors, such as exhaust system or spark timing, can be fairly consistent over time. Other factors may be dependent upon the conditions on a given day. Such variable factors include track surface and condition, and atmospheric conditions such as rain, air density or humidity. Due to these variables, each day the driver may be facing a new course and must quickly determine the fastest manner of passage. On race day, many physical items such as tires, tire pressure, suspension, and tuning can be optimized, and the driving technique altered to minimize time.

Typically, on race day, the first couple of hours are designated as practice time. During practice the drivers attempt to achieve the fastest possible setup for the racing which occurs later that day. The racers experiment with various products and adjustments to achieve maximum performance.

To remain competitive, the racer must consistently achieve the optimum set up and driving style in the brief practice session before each race. To accomplish this, the racer must know the elapsed practice times from a multitude of runs between the same two or more points.

Typically, a racer uses lap time, the time to complete one circuit of the course, or segment time, the time to navigate a particularly critical turn or straight away. Results from various practice configurations are carefully recorded on lap/segment time charts. All decisions as to racing configuration and strategy are based then on the comparative lap/segment times.

Conventionally, many racers operate as a team having a driver and a crew including timers who stand adjacent the course and measure the elapsed lap time or the time between two points. The elapsed time is given to the driver over a radio link or when the driver stops.

Many racers encounter a problem here in that they have no crew for recording/determining elapsed times. One method attempting to overcome the handicap of having no crew included the driver using a stopwatch. Accurate readings could not be obtained with a stopwatch due to the difficulty encountered in accurately starting and stopping the watch while driving.

Therefore, there is a need for a simple and efficient system for a race driver to obtain lap/segment time without outside assistance.

It is particularly desirable that such a system provide the driver with elapsed time without the necessity of the driver stopping so that the driver may continue to practice.

It is also desirable that such a system easily allow a driver to measure elapsed time between any two points on a course. In this manner, the driver can work on improvement in just one part of the course, such as a tight loop or a series of corners.

SUMMARY OF THE INVENTION

Broadly speaking, this invention describes a system and a method for displaying to a person moving on a course the elapsed time between two points on the course. Generally, the person would be on or in a mode of transportation, such as a race car.

A retroreflective switch is attached to the car and includes a transmitter and a receiver. The transmitter emits an infrared light beam such that the light beam strikes a reflector adjacent the course when the car is on the course adjacent the reflector. The receiver includes a light detector that outputs a detection signal in response to detecting the reflected light beam from the reflector.

A processor connected to the receiver receives a first detection signal as the car is adjacent a first reflector and receives a second detection signal when the car is adjacent a second reflector and determines the elapsed time between said first and said second detected signals.

A display connected to the processor receives the elapsed time and displays it to the person. The processor may also be connected to other race car functions and, for example, display maximum engine RPM and temperature for the lap/segment. All such information may be stored in the processor memory for later acquisition.

A first reflector is disposed adjacent the course adjacent the first point on the course for receiving the light beam emitted from the transmitter and for reflecting the light beam back to the receiver. A second reflector is disposed adjacent the course adjacent the second point on the course and similarly aligned. To display lap time only a single reflector is disposed.

Other features and many attendant advantages of the invention will become more apparent upon a reading of the following detailed description together with the drawings in which like reference numerals refer to like parts throughout.

DETAILED DESCRIPTION OF THE INVENTION

Figures 1, 2:
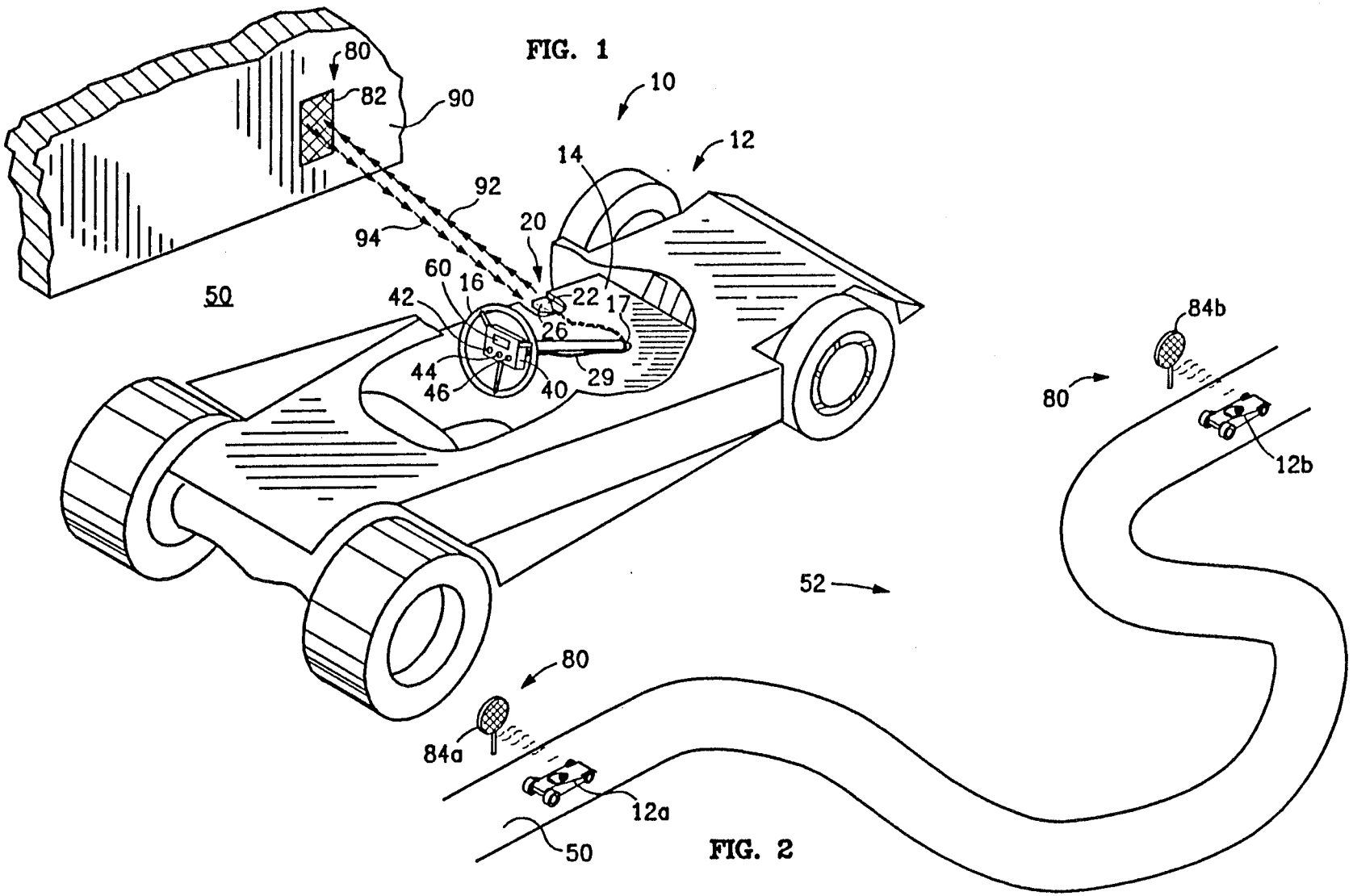
FIG. 1 is perspective view of a preferred embodiment of the invention in use as a lap timer.
FIG. 2 is a perspective view of a method depicting use of the invention to determine elapsed time between two points on a course.

With reference now to the drawing, and more particularly to FIG. 1 thereof, there is shown a preferred embodiment of the distance timer, denoted generally as 10, of the present invention as mounted on a moving object, such as on a race car, denoted generally as 12 that is on a race course 50. Distance timer 10 generally comprises retroreflective switch means, denoted generally as 20, processor means, denoted generally as 40, and a display means 60.

The system of the invention includes a reflector means 80, such as reflective strip 82, mounted, such as on a post, pylon or wall 90, adjacent the race course.

Retroreflective switch 20 is mounted to car 12, such as to the underside of chassis 14 as shown in cut away or any other suitable location. Retroreflective switch 20 includes a transmitter means 22 for emitting a beam of light, such as emitted infrared beam 92, and a receiver means 26 including a light detector means for detecting a light beam and for producing a detection signal, i.e. a switching current, in response thereto. Preferably, transmitter 22 emits a high frequency pulsed infrared beam 92 with a minimum pulse rate of one hundred pulses per second. The use of infrared light has been found suitable because it reduces spurious reflections, such as off chrome. Other forms of radiation, such as laser, may also be used. In the preferred embodiment, receiver 26 detects reflected infrared beam 94. Transmitter 22, receiver 26, and reflector 80 are positioned so that emitted beam 92 strikes reflector 80 and the reflected beam 94 strikes receiver 26.

A retroreflective switch such as described above is commercially available from many sources including the MicroSwitch company of Freeport, Ill. Such switch is commonly used to detect breakage of the beam caused by passage of an object between the switch and the reflector, such as by a person entering a doorway having the switch on one side and the reflector on the other. The switch 20 may be quite small, such as two inches by one inch by one-half inch which allows it to be easily mounted with no hindrance to the driver. The retroreflective switching apparatus may also be built of separate transmitter and receiver, both mounted to the vehicle to achieve the same result.

Switch 20 is connected, such as by cable 29, to processor 40. In the preferred embodiment shown, processor 40 is mounted in the center of the steering wheel 16 of car 12 and cable 29 passes down along side of the steering column 17. Processor 40 is connected to receiver 26 and receives therefrom the beam detection signal when reflected beam 94 is detected.

Display 60, connected to processor 40, receives the elapsed time from the processor and presents it to the driver in any suitable form; preferably one that causes the least distraction from the duties of driving. The elapsed time is displayed until the next reflector is passed, at which time the process is repeated. An LCD display has been found suitable. In some applications an audible message may be preferred.

Basically, processor 40 works as follows. Processor 40 outputs to display 60 the time lapse between a first detection signal and a second detection signal. Essentially, it accomplishes this by first looking for a detection signal. When a detection signal is received a timer is read or started. A lock-out or delay period is initiated to allow car 12 to pass reflector 80 such that the detection signal is no longer present. Processor 40 then looks for a second detection signal. Upon receipt of the second detection signal, the timer difference is read and stored in memory and displayed on display 60 such that the driver may easily see it while driving. In this manner, and with the apparatus shown in FIG. 1, a driver may immediately be given the lap time upon passing the reflective strip 82 the second time. This process may continue without the need for resetting. Thus, no times are lost and all segments are accurately timed.

It is well known to those skilled in the microprocessing art that the appropriate circuitry and software is easily designed to provide a processing means as described. Various switches, such as start switch 42, reset switch 44, and memory switch 46, control processor 40. A processor including a programmable microprocessor can easily store a multiplicity of elapsed times and other data, such as maximum tachometer and temperature for the lap/segment, for delayed display and review. Use of a microprocessor also easily permits the use of a multiplicity of reflectors to further split the lap time into the elapsed times for smaller segment distances will be more fully described below.

The first prototype of the invention did not use a microprocessor but instead used a commercially available stopwatch with a built in Taylor Split algorithm such that it output lap times with only one switching motion, i.e. no reset cycle is required. The retroreflective switch detection signal was amplified to activate the stopwatch. In this configuration, a grounded shield on cable 29 was needed to prevent interference from electromagnetic engine noise.

Turning now to FIG. 2 there is shown a perspective view of a use of the invention to display the elapsed time between two points on a course. A race course 50 includes a turn, such as oxbow turn 52. Conventionally, a driver wanting to practice on this turn with various car configurations and driving technique, has no good means for accurately timing passage. However, with the current invention, the driver need only place a reflector means 80, such as first reflective disk 84*a*, adjacent course 50 adjacent a first course location indicated by car 12*a* and a reflector means 80, such as second reflector disk 84*b*, adjacent course 50 adjacent a second course location indicated by car 12*b*. The reflectors are positioned so as to reflect an emitted beam from car 12 back to the receiver. It has been found that a conventional bicycle reflector mounted on a wire post or stick stuck into the ground is suitable for reflecting an infrared light beam and very handy when no wall is present. Of course, any suitable type of reflector, such as the tape reflector 82 of FIG. 1 could be used. The equipment aboard the car is operated in a similar manner to that described in reference to FIG. 1. In this manner, the driver is provided with the elapsed time between any two points repeatedly for comparison.

Use of a programmable microprocessor as a processor allows the driver to place a plurality of reflectors around a course and by informing the processor of the number of strips, such as through input switches or programming, the processor can display the times for each segment as well as the total lap time. Of course, other computations can be displayed simultaneously, such as previous time or previous best time. Computations can be stored for later interface and readout from a printer.

It can be appreciated that many uses of the device are possible. Because of the low voltage and power requirements, typically one or two small nine volt batteries, the unit is small enough not to interfere with the operating parameters of the car. The system and method of the present invention can be used in conjunction with any moving object including cars, karts, bicycles, motorcycles, horses.

The prototypes are probably a little big to be carried by a runner without interfering with performance, but with dedicated integrated circuitry, invention can easily be made small enough for even such use.

Although a particular embodiment of the invention has been illustrated an described, various changes may be made in the form, construction, and arrangement of the parts herein without sacrificing any of its advantages, and it is to be understood that all matter herein is to be interpreted as illustrative and not in any limiting sense, and it is intended to cover in the appended claims such modifications and changes as come within the true spirit and scope of the invention.

We claim:

1. A method for displaying lap time to a person moving in, a circuitous course comprising the steps of:

placing a light beam reflector adjacent the course;

attaching to a moving object including a person a transmitter that emits a light beam;

positioning the transmitter such that the emitted light beam will strike the reflector when the moving object is on the course adjacent the reflector;

positioning the light reflector such that a light beam received by the reflector from the transmitter will be reflected to the moving object;

attaching a receiver including a light detector to the moving object such that the detector detects the reflected light beam;

moving the moving object along the course such that the reflected light beam is detected by the light detector on two separate occasions;

determining the elapsed time between the detected beams with a processor connected to the receiver that, in response to light beam detection by the detector, determines the elapsed time between the first and the second reflected light beams, and displaying to the person the elapsed time determined by the processor with a display connected to the processor.

2. The method of claim 1 wherein the light beam is infrared.

3. The method of claim 1 wherein the light beam is laser.

4. The method of claim 1 wherein the light beam is pulsed.

5. The method of claim 1 wherein the display is a visual display.

6. The method of claim 1 further including the step of:

storing the determined elapsed time for later use.

7. A method for displaying to a person moving on a course the elapsed time between two points on the course; the method comprising the steps of:

placing a light beam reflector adjacent the course adjacent the first point on the course;

placing a light beam reflector adjacent the course adjacent the second point on the course;

attaching to a moving object including a person a transmitter that emits a light beam;

positioning the transmitter such that the emitted light beam will strike a placed reflector when the moving object is on the course adjacent that reflector;

positioning each light reflector such that a light beam received by the reflector from the transmitter will be reflected to the moving object;

attaching a receiver having light beam detector means to the moving object such that the light beam detector detects the reflected light beam;

moving the moving object along the course such that the reflected light beam is detected by the light detector on two separate occasions;

determining the elapsed time between the detected beams with a processor connected to the receiver that, in response to light beam detection by the detector, determines the elapsed time between the first and the second reflected light beams, and displaying to the person the elapsed time determined by the processor with a display connected to the processor.

8. The method of claim 7 wherein the light beam is infrared.

9. The method of claim 7 wherein the light beam is laser.

10. The method of claim 7 wherein the light beam is pulsed.

11. The method of claim 7 wherein the display is a visual display.

12. The method of claim 7 further including the step of:

storing the determined elapsed time for later use.

13. A self timing system for displaying lap time to a person moving on a circuitous course; said system comprising;

moving object means including a person for moving on a circuitous course;

transmitter means attached to said moving object means for emitting a light beam such that said light beam strikes a reflector means adjacent the circuitous course when said moving object is on the circuitous course adjacent said reflector means;

reflector means disposed adjacent the circuitous course for receiving said light beam emitted from said transmitter means and for reflecting said light beam back to a receiver means on said moving object;

receiver means including light detector means attached to said moving object for detecting said reflected light beam from said reflector means and for outputting a detection signal in response thereto;

processing means connected to said receiver means; said processing means for receiving a first said detection signal as said moving object is first adjacent said reflector means and, after a time delay, for receiving a second detection signal when said moving object is adjacent said reflector means, and for determining the elapsed time between said first and said second detected signal; and display means connected to said processing means for receiving said determined elapsed time and for displaying said determined elapsed time to said person.

14. The self timer of claim 13 wherein said light beam is an infrared beam.

15. The self timer of claim 13 wherein said light beam is a laser.

16. The self timer of claim 13 wherein said light beam is a pulsed beam.

17. The self timer of claim 13 wherein said processing means includes a time delay lock out after receiving said first detection signal.

18. The self timer of claim 13 wherein said display is a visual display.

19. The self timer of claim 13 including storage means for storing the determined elapsed time for later retrieval.

20. A self timing system for displaying to a person moving on a course the elapsed time between two points on the course; said system comprising;

moving object means including a person for moving on a course;

transmitter means attached to said moving object means for emitting a light beam such that said light beam strikes a reflector means adjacent the course when said moving object means is on the course adjacent a reflector means;

first reflector means disposed adjacent the course adjacent the first point on the course for receiving said light beam emitted from said transmitter means when said moving object means is at said first point and for reflecting said light beam back to a receiver means on said moving object means;

second reflector means disposed adjacent the course adjacent the second point on the course for receiving said light beam emitted from said transmitter means when said moving object means is at said second point and for reflecting said light beam back to a receiver means on said moving object means;

receiver means including light detector means attached to said moving object means for outputting a detection signal in response to detecting said reflected light beam from said reflector means;

processing means connected to said receiver means; said processing means for receiving a first said detection signal as said moving object is adjacent said first reflector means and for receiving a second detection signal when said moving object is adjacent said second reflector means, and for determining the elapsed time between said first and said second detected signals; and display means connected to said processing means for receiving said elapsed time and for displaying said elapsed time to said person.

21. The self timer of claim 20 wherein said light beam is an infrared beam.

22. The self timer of claim 20 wherein said light beam is a laser.

23. The self timer of claim 20 wherein said light beam is a pulsed beam.

24. The self timer of claim 20 wherein said processing means includes a time delay lock out after receiving said first detection signal.

25. The self timer of claim 20 wherein said display is a visual display.

26. The self timer of claim 20 including storage means for storing the determined elapsed time for later retrieval.

* * * * *